US009941628B2

(12) United States Patent
Hashiguchi

(10) Patent No.: US 9,941,628 B2
(45) Date of Patent: Apr. 10, 2018

(54) CONNECTOR ASSEMBLY

(71) Applicant: Japan Aviation Electronics Industry, Limited, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/597,468

(22) Filed: May 17, 2017

(65) Prior Publication Data

US 2018/0026395 A1 Jan. 25, 2018

(30) Foreign Application Priority Data

Jul. 20, 2016 (JP) ..... 2016-142583

(51) Int. Cl.
*H01R 13/627* (2006.01)

(52) U.S. Cl.
CPC ..... *H01R 13/6272* (2013.01)

(58) Field of Classification Search
CPC ..... H01R 13/6276
USPC ..... 439/348
See application file for complete search history.

(56) References Cited

U.S. PATENT DOCUMENTS 5,632,643 A * 5/1997 Shepherd ..... A61B 5/04286 439/346
6,813,158 B2 11/2004 Yanagi

FOREIGN PATENT DOCUMENTS

| | | |
|---|---|---|
| JP | H02-123679 A | 5/1990 |
| JP | 2003-022852 A | 1/2003 |
| JP | 2011-070831 A | 4/2011 |
| JP | 2016-096684 | 5/2016 |

* cited by examiner

*Primary Examiner* — Ross Gushi
(74) *Attorney, Agent, or Firm* — Collard & Roe, P.C.

(57) ABSTRACT

A connector assembly includes first and second connectors. The first connector has a first housing and a first locking portion. The second connector has a second housing and a second locking portion. The first housing is formed with a resiliently supporting portion which rotatably supports the first locking portion. The first locking portion is positioned between a front end and a rear end of the first housing in a mating direction. When the first connector is mated with the second connector, the second locking portion is positioned between the first locking portion and the rear end of the first housing in the mating direction. When seen along the mating direction, the first locking portion and the second locking portion have a first extent and a second extent, respectively, in an orthogonal direction. When the first connector is mated with the second connector, the first extent overlaps with the second extent.

12 Claims, 10 Drawing Sheets

CONNECTOR ASSEMBLY

CROSS REFERENCE TO RELATED APPLICATIONS

This application is based on and claims priority under 35 U.S.C. § 119 to Japanese Patent Application No. JP2016-142583 filed Jul. 20, 2016, the contents of which are incorporated herein in their entirety by reference.

BACKGROUND OF THE INVENTION

This invention relates to a connector assembly, particular to a connector assembly which is provided with a lock mechanism, what is called a friction lock.

Referring to FIGS. 13 to 15, JPA 2011-070831 (Patent Literature 1) discloses a first connector 900 and a second connector 950 which are provided with a socket housing 910 and a pin housing 960, respectively. The socket housing 910 is provided with a lock portion 920 having a locking portion (first locking portion) 924. The locking portion 924 is supported by a supporting portion 922 which is resiliently deformable. On the other hand, the pin housing 960 is formed with a hole portion 962 which corresponds to the locking portion 924 of the socket housing 910. The first connector 900 and the second connector 950 are mated with each other to form a connector assembly.

As shown in FIG. 15, the locking portion 924 protrudes upward from the socket housing 910. At the beginning of mating the first connector 900 with the second connector 950 as shown by an outline arrow in FIG. 15, the locking portion 924 is brought into abutment with the pin housing 960. Then, the supporting portion 922 (see FIG. 13) is resiliently deformed, and the locking portion 924 is moved downward or toward a negative-Z direction. Accordingly, the first connector 900 can come into the second connector 950 in part. After that, when the locking portion 924 reaches the hole portion 962, the locking portion 924 comes into the hole portion 962 at least in part as shown in FIG. 16 due to a reaction force of the supporting portion 922. Thus, the first connector 900 and the second connector 950 are in a mated state. When the first connector 900 and the second connector 950 are applied with a separation direction force while under the mated state, the locking portion 924 is brought into abutment with an edge (second locking portion) of the hole portion 962. Consequently, the first connector 900 cannot be substantially pulled out from the second connector 950. Thus, the lock portion 920 and the hole portion 962 lock the mated state of the first connector 900 and the second connector 950.

It needs a jig or a lock release operation to release the lock achieved by the lock portion 920 and the hole portion 962 of Patent Literature 1. However, depending on an intended purpose of a connector assembly, there is a demand for a lock mechanism that a first connector and a second connector of the connector assembly can be separated from each other without a jig or a special release operation. Such a lock mechanism can be formed by changing shapes and sizes of the first locking portion and the second locking portion. In detail, the lock mechanism should be structured so that a lock between the first locking portion and the second locking portion is released when the first connector and the second connector are applied with the separation direction force exceeding a predetermined force. The lock mechanism which can release the locked state only by the separation direction force as mentioned above is referred to as a friction lock mechanism.

In a friction lock mechanism having a structure similar to the lock mechanism disclosed in Patent Literature 1, a first locking portion is pressed against a pin housing by a supporting portion supporting the first locking portion and, in that state, slides on a surface of the pin housing when the first connector and the second connector are mated with or separated from each other. In addition, when the first connector and the second connector are separated from each other, the first locking portion and the second locking portion are strongly rubbed with each other. In this manner, the first locking portion and the second locking portion, especially the first locking portion, are worn away and changed in shape or size by repetition of mating and removing of the first connector and the second connector. Therefore, a lock force given by the friction lock mechanism is reduced.

SUMMARY OF THE INVENTION

It is an object of the present invention to provide a connector assembly having a friction lock mechanism which can suppress size change of lock portions caused by repetition of mating and removing and suppress reduction of a lock force.

One aspect of the present invention provides a connector assembly comprising a first connector and a second connector which are mateable with each other along a mating direction. The first connector comprises a first housing and a first locking portion. The first housing has a front end and a rear end in the mating direction. The first locking portion is positioned between the front end and the rear end of the first housing in the mating direction. The first locking portion comprises a solid of revolution which is distinct and separated from the first housing and rotatably supported by the first housing. The second connector comprises a second housing and a second locking portion. At least one of the first housing and the second housing is formed with a resiliently supporting portion which is resiliently deformable. At least one of the first locking portion and the second locking portion is supported by the resiliently supporting portion to be movable in a direction intersecting with the mating direction. When the first connector is mated with the second connector, the second locking portion is positioned between the first locking portion and the rear end of the first housing in the mating direction. When seen along the mating direction, the first locking portion and the second locking portion have a first extent and a second extent, respectively, in an orthogonal direction orthogonal to the mating direction. When the first connector is mated with the second connector, the second extent overlaps with the first extent.

In the connector assembly of the present invention, the first locking portion of the first connector is the solid of revolution and rotatably supported by the first housing. When the first connector and the second connector are mated with or removed from each other, the first locking portion is brought into abutment with the second locking portion, and then at least one of the first locking portion and the second locking portion is moved in the direction intersecting with the mating direction due to resilient deformation of the resiliently supporting portion. Simultaneously, the first locking portion is rotated to suppress abrasion caused by rubbing the first locking portion and the second locking portion against each other. Accordingly, it is suppressed that the abrasion changes shapes of the first locking portion and the second locking portion and that a lock force given by the first locking portion and the second locking portion is reduced.

An appreciation of the objectives of the present invention and a more complete understanding of its structure may be had by studying the following description of the preferred embodiment and by referring to the accompanying drawings.

Figure 1:
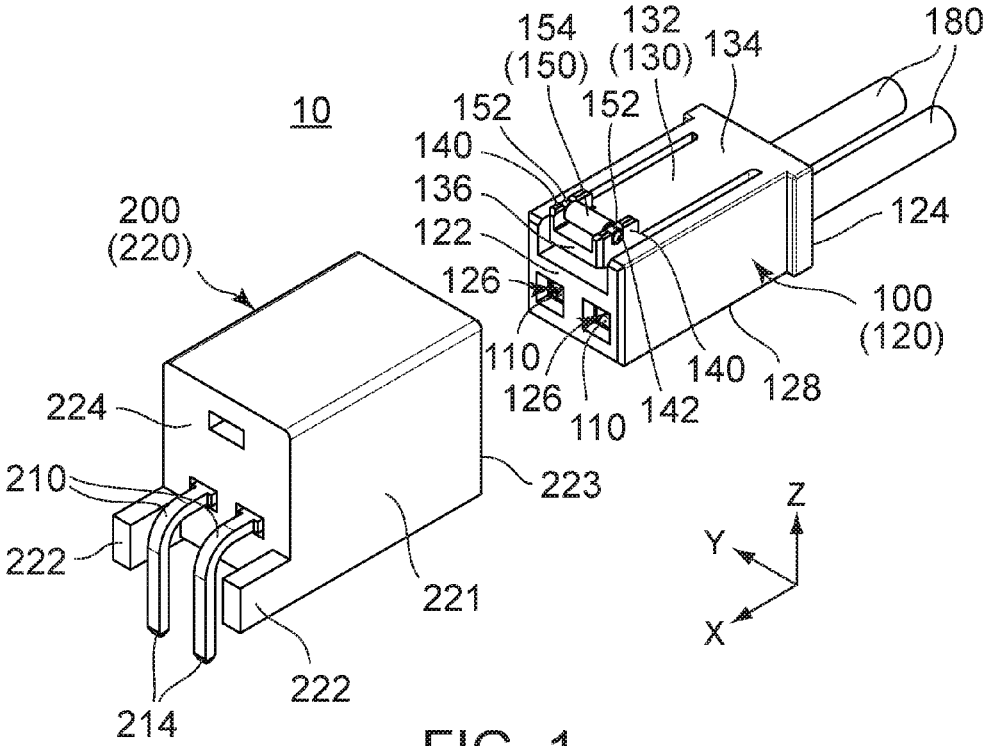
FIG. 1 is a perspective view showing a connector assembly according to a first embodiment of the present invention. A first connector and a second connector are in a separated state.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, equivalents and alternatives falling within the spirit and scope of the present invention as defined by the appended claims.

DESCRIPTION OF PREFERRED EMBODIMENTS

First Embodiment

Referring to FIGS. 1 to 6, a connector assembly 10 according to a first embodiment of the present invention is provided with a first connector 100 and a second connector 200. As understood from FIGS. 1 to 6, the first connector 100 and the second connector 200 are mateable with each other along a mating direction. In the present embodiment, the mating direction is a direction along an X-direction. In detail, the mating direction of the first connector 100 is a positive-X direction while the mating direction of the second connector 200 is a negative-X direction.

As understood from FIGS. 1 to 6, the first connector 100 is a plug connector which can be accommodated in the second connector 200 in part. The first connector 100 has a plurality of socket contacts 110, a first housing 120 and a first locking portion 150. The first housing 120 holds the socket contacts 110 and rotatably supports the first locking portion 150. The socket contacts 110 are made of metal. Each of the first housing 120 and the first locking portion 150 is made of insulating resin. The first locking portion 150 is formed to be distinct and separated from the first housing 120.

Figure 2:
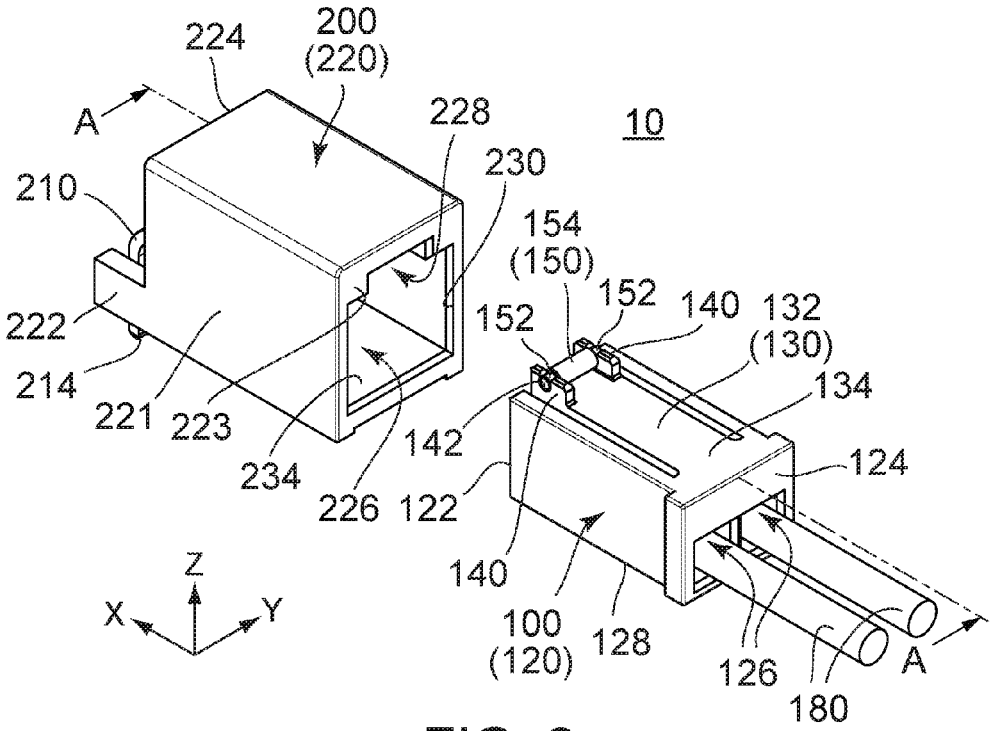
FIG. 2 is another perspective view showing the connector assembly of FIG. 1.

As understood from FIGS. 1 and 2, the first housing 120 is provided with a plurality of holes 126 which pierce the first housing 120 from a front end 122 thereof to a rear end 124 thereof in the mating direction. The holes 126 are arranged in a first orthogonal direction, i.e. a pitch direction, orthogonal to the mating direction. In the present embodiment, the pitch direction is a Y-direction. The socket contacts 110 are accommodated in the holes 126, respectively. Moreover, the socket contacts 110 are connected to cables 180 inside the first housing 120, respectively. The cables 180 are routed outward from the rear end 124 of the first housing 120. However, the present invention is not limited thereto. The present invention is applicable to others irrespective of the number and arrangement of the holes 126 or the socket contacts 110.

Figure 3:
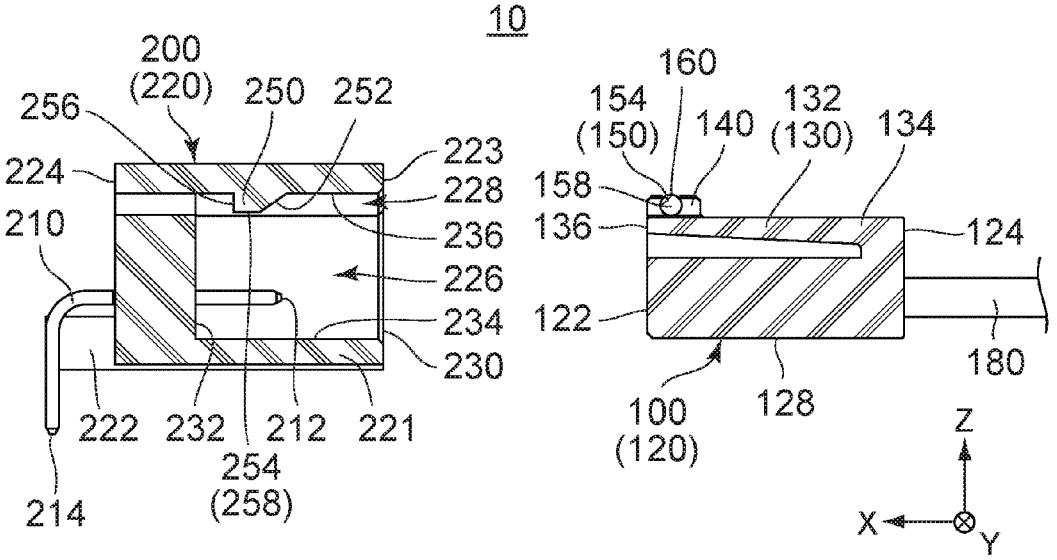
FIG. 3 is a cross-sectional view showing the connector assembly of FIG. 2, taken along A-A line.

As shown in FIGS. 1 to 3, the first housing 120 has a supporting portion 130 which supports the first locking portion 150. The supporting portion 130 has a resiliently supporting portion 132 and a pair of supporting stands 140. The resiliently supporting portion 132 has a cantilever shape. The supporting stands 140 are supported by the resiliently supporting portion 132. The resiliently supporting portion 132 has a plate-like shape and two ends in a longitudinal direction thereof. One of the ends of the resiliently supporting portion 132 is a fixed end 134 while the other end is a free end 136. The fixed end 134 of the resiliently supporting portion 132 is positioned nearer to the rear end 124 of the first housing 120. In other words, the fixed end 134 is positioned between the free end 136 and the rear end 124 of the first housing 120. The resiliently supporting portion 132 extends from the fixed end 134 toward the front end 122 of the first housing 120 along the mating direction. The free end 136 of the resiliently supporting portion 132 forms a part of the front end 122 of the first housing 120 in the present embodiment. The supporting stands 140 are disposed near the free end 136 of the resiliently supporting portion 132. The supporting stands 140 have front ends. In the present embodiment, the front ends of the supporting stands 140 and the free end 136 of the resiliently supporting portion 132 are coincide with each other in position of the mating direction. However, the front ends of the supporting stands 140 and the free end 136 of the resiliently supporting portion 132 may not be coincide with each other in position of the mating direction. The supporting stands 140 are formed as small rectangular pieces and arranged at both ends of the resiliently supporting portion 132 in the pitch direction to be parallel to each other. The supporting stands 140 protrude upward along a second orthogonal direction, i.e. an up-down direction, orthogonal to both of the mating direction and the pitch direction. Each of the supporting stands 140 is formed with a bearing portion 142 at an upper side thereof. The bearing portion 142 has a cross-sectional shape of an imperfect circle when seen along the pitch direction. In detail, the bearing portion 142 is a groove which is opened upward. The cross-sectional shape of the bearing portion 142 is a part of a circle (major arc) having a diameter slightly larger than a diameter of a supported portion 152 described later. The cross-sectional shape of the bearing portion 142 has an interval or a length of a chord between both ends thereof. The interval is smaller than the diameter of the supported portion 152. However, the shape of the bearing portion 142 is not limited thereto in the present invention. The bearing portion 142 may have any shape provided that it can support rotatably the supported portion 152. In the present embodiment, the up-down direction is a Z-direction while an upward direction is a positive-Z direction. The resiliently supporting portion 132 is resiliently deformable. The free end 136 of the resiliently supporting portion 132 is movable in a direction intersecting with the mating direction. The first locking portion 150 is rotatably supported by the supporting stands 140 and therefore supported by the first housing 120. The first locking portion 150 supported by the supporting stands 140 is movable in the direction intersecting with the mating direction according to the resilient deformation of the resiliently supporting portion 132.

As understood from FIGS. 1 to 6, the second connector 200 is a receptacle connector which can accommodate the first connector 100 in part. The second connector 200 has a plurality of pin contacts 210, a second housing 220 and a second locking portion 250. The second housing 220 holds the pin contacts 210. The second housing 220 has a body 221 and a pair of protruding portions 222 protruding rearward from the body 221. The pin contacts 210 are made of metal. Each of the second housing 220 and the second locking portion 250 is made of insulating resin. The second locking portion 250 is integrally formed with the second housing 220.

As understood from FIGS. 2 and 3, the body 221 of the second housing 220 has a front end 223 in the mating direction. The body 221 is formed with an accommodation portion 226 which opens in the front end. The accommodation portion 226 extends from an opening 230 to a back wall 232 in the mating direction. The accommodation portion 226 accommodates the first connector 100 in part when the first connector 100 and the second connector 200 are mated with each other. Moreover, the body 221 of the second housing 220 is formed with a groove portion 228 which extends from the front end 223 toward a rear end 224 thereof in the mating direction. The groove portion 228 extends toward the rear end 224 beyond the second locking portion 250 in the mating direction. The groove portion 228 opens toward the accommodation portion 226 and is hollowed upward. The groove portion 228 allows the first locking portion 150 and the supporting stands 140 to pass it when the first connector 100 and the second connector 200 are mated with or separated (removed) from each other. In other words, the groove portion 228 is formed so that the first locking portion 150 is movable inside the groove portion 228 at least in part along the mating direction.

As understood from FIGS. 1 to 3, the pin contacts 210 are held by the second housing 220 so that tips 212 of them are positioned in the accommodation portion 226 while rear ends 214 of them are positioned outside the second housing 220. The pin contacts 210 are arranged to correspond to the socket contacts 110. The pin contacts 210 are electrically connected to the socket contacts 110 when the first connector 100 and the second connector 200 are mated with each other. The rear ends 214 of the pin contacts 210 are connected and fixed to a circuit board (not shown). The second locking portion 250 is placed in the groove portion 228 and protrudes toward the accommodation portion 226.

As described above, in the present embodiment, one of the first housing 120 and the second housing 220 is formed with the resiliently supporting portion 132 while one of the first locking portion 150 and the second locking portion 250 is supported by the resiliently supporting portion 132. Specifically, the first housing 120 is formed with the resiliently supporting portion 132 while the first locking portion 150 is supported by the resiliently supporting portion 132. Moreover, the remaining one of the first housing 120 and the second housing 220 is formed with the groove portion 228. Specifically, the second housing 220 is formed with the groove portion 228.

As apparent from FIGS. 1 to 3, the first locking portion 150 is a solid of revolution. In detail, the first locking portion 150 consists of three cylindrical columns, i.e. two supported portions 152 and a contact portion 154. However, the present invention is not limited thereto. The contact portion 154 may be a single sphere, a plurality of spheres arranged in the pitch direction, a plurality of cylindrical columns arranged in the pitch direction, a plurality of disks arranged in the pitch direction or the like. The two supported portions 152 have a relatively small diameter (first diameter) and rotatably supported by the supporting stands 140. In detail, the supported portions 152 are rotatably put in the bearing portions 142 of the supporting stands 140. The contact portion 154 has a relatively large diameter (second diameter) and is positioned between the supported portions 152 in the pitch direction. The contact portion 154 comes into contact with the second locking portion 250 when the first connector 100 and the second connector 200 are mated with or separated (removed) from each other. Each of the supported portions 152 and the contact portion 154 has a central axis. The central axes of the supported portions 152 and the central axis of the contact portion 154 coincide with one another. The first locking portion 150 can be easily rotated by an external force applied to the contact portion 154 because the first diameter of the supported portions 152 is smaller than the second diameter of the contact portion 154.

As shown in FIGS. 1 to 3, the first locking portion 150 is positioned between the front end 122 of the first housing 120 and the rear end 124 of the first housing 120 in the mating direction. This is to allow the first locking portion 150 to work as a lock mechanism together with the second locking portion 250 when the first connector 100 and the second connector 200 are mated with each other. Moreover, the first locking portion 150 is positioned nearer to the free end 136 of the resiliently supporting portion 132 than to the fixed end 134 of the resiliently supporting portion 132. This is to facilitate moving of the first locking portion 150 caused by resilient deformation of the resiliently supporting portion 132 when the first locking portion 150 comes into contact or is brought into abutment with the second locking portion 250 and to increase moving amount of the first locking portion 150.

Figure 6:
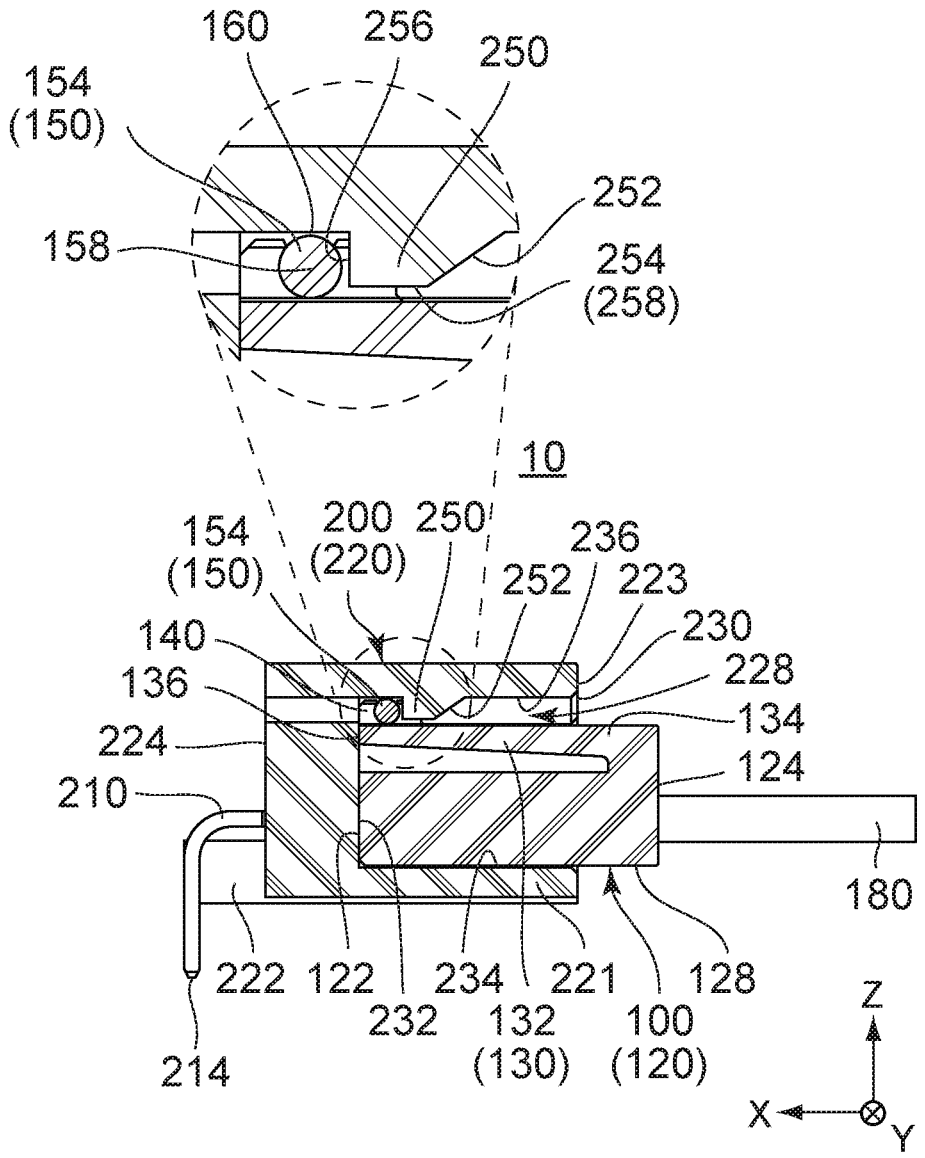
FIG. 6 is a cross-sectional view showing the connector assembly of FIG. 5, taken along B-B line. In the figure, a first locking portion, a second locking portion and the vicinity of them are enlarged and shown.

As shown in FIGS. 3 and 6, the second locking portion 250 is provided in a position nearer to the opening 230 of the accommodation portion 226 than to the back wall 232 of the accommodation portion 226. In the present embodiment, the second locking portion 250 is positioned approximately in the middle of the body 221 of the second housing 220 in the mating direction. The position of the second locking portion 250 is decided on the basis of the position of the first locking portion 150. This is to allow the second locking portion 250 to function appropriately as the lock mechanism together with the first locking portion 150. The second locking portion 250 has a front surface 252, an under surface 254 and a rear surface 256. The front surface 252 is inclined to the mating direction. In detail, the front surface 252 is inclined so that protrusion amount of the second locking portion 250 is gradually increased toward the rear end 224 of the second housing 220 from the front end 223 of the second housing 220. The under surface 254 is perpendicular to the up-down direction. The rear surface 256 is perpendicular to the mating direction. However, the present invention is not limited thereto. Each of the front surface 252, the under surface 254 and the rear surface 256 may be appropriately designed about a degree of inclination thereof and a size thereof on the basis of a desired lock force. Moreover, at least one of the front surface 252, the under surface 254 and the rear surface 256 may be a curved surface.

Figure 4:
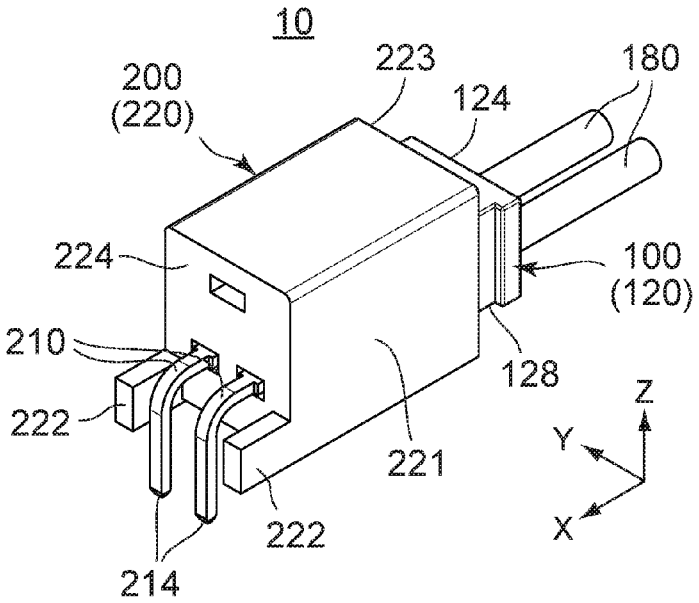
FIG. 4 is still another perspective view showing the connector assembly of FIG. 1. The first connector and the second connector are in a mated state.
Figure 5:
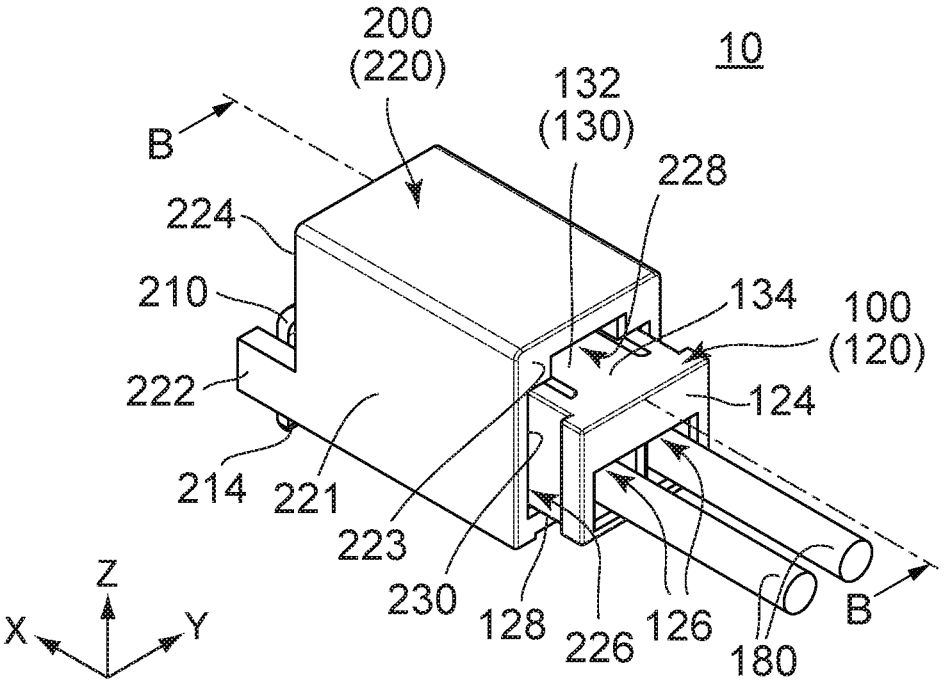
FIG. 5 is another perspective view showing the connector assembly of FIG. 4.

To mate the first connector 100 with the second connector 200, the first connector 100 and the second connector 200 face each other as shown in FIGS. 1 to 3. In detail, the front end 122 of the first housing 120 faces the front end 223 of the body 221 of the second housing 220. Then, each of the first connector 100 and the second connector 200 is moved in the mating direction thereof from a separated state as shown in FIGS. 1 to 3. As a result, as shown in FIGS. 4 to 6, the first connector 100 and the second connector 200 shift into a mated state that the first connector 100 and the second connector 200 are mated with each other. As understood from FIGS. 1 to 6, during mating, the first connector 100 is accommodated in the accommodation portion 226 of the second connector 200 in part, and the first locking portion 150 is moved in the groove portion 228 at least in part along the mating direction. In a state that an under surface 128 of the first housing 120 comes into contact with a bottom surface 234 of the accommodation portion 226, the first locking portion 150 may come into contact with or be apart from a bottom surface 236 of the groove portion 228. Even though the first locking portion 150 comes into contact with the bottom surface 236 of the groove portion 228, abrasion of the first locking portion 150 and the first housing 120 is suppressed because the first locking portion 150 is rotatable. In the present embodiment, the first locking portion 150 comes into contact with the bottom surface 236 of the groove portion 228 without resiliently deforming the resiliently supporting portion 132.

As understood from FIGS. 3 and 6, in the middle of the mating, the first locking portion 150 is brought into abutment or comes into contact with the second locking portion 250. By applying a mating direction force stronger than a first predetermined force to the first connector 100 and the second connector 200, the first locking portion 150 rides on the front surface 252 of the second locking portion 250 and is moved on the under surface 254 to ride over the second locking portion 250. In this event, the resiliently supporting portion 132 is resiliently deformed and presses the first locking portion 150 against the second locking portion 250 with a reaction force thereof. However, abrasion of the first locking portion 150 and the second locking portion 250 is suppressed because the first locking portion 150 is rotated. When the first locking portion 150 rides over the second locking portion 250, the first locking portion 150 is stopped in a position where it overlaps with the second locking portion 250 when seen along the mating direction. Thus, the first locking portion 150 and the second locking portion 250 lock the mated state of the first connector 100 and the second connector 200.

When the first connector 100 and the second connector 200 are mated with each other as shown in FIG. 6, i.e. in a locked state, positional relationships among portions are as follows. The free end 136 of the resiliently supporting portion 132 is accommodated in the accommodation portion 226 of the second housing 220. Accordingly, the first locking portion 150 cannot be operated using a jig or the like. The first locking portion 150 is positioned between the second locking portion 250 and the back wall 232 in the mating direction. On the other hand, the second locking portion 250 is positioned between the first locking portion 150 and the rear end 124 of the first housing 120 in the mating direction. Moreover, when seen along the mating direction, the first locking portion 150 and the second locking portion 250 have a first extent and a second extent, respectively, in the up-down direction. The first extent of the first locking portion 150 and the second extent of the second locking portion 250 overlap with each other. In addition, the second locking portion 250 is apart from the resiliently supporting portion 132 in the up-down direction. In detail, the first locking portion 150 and the second locking portion 250 have a first end 160 and a second end 258, respectively, in the up-down direction. The second end 258 of the second locking portion 250 is positioned between the resiliently supporting portion 132 and the first end 160 of the first locking portion 150 in the up-down direction. In other words, one of the first end 160 and the second end 258 that corresponds to a remaining one of the first locking portion 150 and the second locking portion 250, which is not supported by the resiliently supporting portion 132, is positioned between the resiliently supporting portion 132 and a remaining one of the first end 160 and the second end 258 in the up-down direction. In more detail, the second end 258 of the second locking portion 250 is positioned between the resiliently supporting portion 132 and a rotation center of the first locking portion 150 in the up-down direction. Furthermore, the whole of the resiliently supporting portion 132 is positioned below the second locking portion 250 in the up-down direction. It should be noted that the first end 160 of the first locking portion 150 is a part of a surface of the contact portion 154. Moreover, the second end 258 of the second locking portion 250 is identical to the under surface 254. Furthermore, the rotation center of the first locking portion 150 is identical to a central axis 158 of the first locking portion 150. According to the positional relationships of the portions as mentioned above, the lock state can be certainly maintained.

As understood from FIG. 6, when the first connector 100 and the second connector 200 are applied with a separation direction force separating them from each other along the mating direction, the first locking portion 150 is brought into abutment with the second locking portion 250. At this time, the first locking portion 150 receives a force in the mating direction, and the force is transmitted to the resiliently supporting portion 132. The resiliently supporting portion 132 extends in the mating direction and is fixed at the fixed end 134. Moreover, a direction of the force applied to the first locking portion 150 (the mating direction) is inclined to a straight line connecting a point of the first locking portion 150 applied with the force (point of action) and the fixed end 134 (fulcrum). Accordingly, a downward force is generated in the vicinity of the free end 136 of the resiliently supporting portion 132. Depending on magnitude of the force applied to the free end 136, the resiliently supporting portion 132 can be resiliently deformed greatly. When the separation direction force is equal to or less than a second predetermined force, the first locking portion 150 cannot ride over the second locking portion 250. In other words, the first locking portion 150 and the second locking portion 250 maintain the locked state of the first connector 100 and the second connector 200 in this case. In contrast, when the separation direction force exceeds the second predetermined force, the resiliently deformation of the resiliently supporting portion 132 becomes large, and the first locking portion 150 rides over the second locking portion 250 to be moved toward the front end 223 of the second housing 220. In detail, provided that the central axis 158 of the first locking portion 150 moves downward of the under surface 254 of the second locking portion 250 in the up-down direction, the first connector 100 and the second connector 200 can be separated, after the movement of the central axis 158, from each other by the separation direction force even weaker than the second predetermined force. This is because the force applied from the second locking portion 250 to the first locking portion 150 works to rotate the first locking portion 150. Thus, the lock of the mated state of the first connector 100 and the second connector 200 is released, and the first connector 100 and the second connector 200 can be separated from each other.

As described above, in the connector assembly 10 according to the present embodiment, the first locking portion 150 and the second locking portion 250 function as a friction lock mechanism which locks the mated state when the mating direction force exceeding the first predetermined force is applied thereto and which releases the lock when the separation direction force exceeding the second predetermined force is applied thereto. Since the first locking portion 150 is rotated when the first locking portion 150 rides over the second locking portion 250, the abrasion of the first locking portion 150 and the second locking portion 250 is suppressed. By the way, the rotation of the first locking portion 150 may causes abrasion between the supported portion 152 and the bearing portions 142 of the supporting stands 140. However, the abrasion between the supported portion 152 and the bearing portions 142 hardly affect a lock force produced by the first locking portion 150 and the second locking portion 250. Therefore, the lock force is hardly decreased by repetition of mating and separating of the first connector 100 and the second connector 200.

Second Embodiment

Referring to FIGS. 7 to 12, a connector assembly 10A according to a second embodiment of the present invention is provided with a first connector 100A and a second connector 200A. As understood from FIGS. 7 to 12, the first connector 100A and the second connector 200A are mateable with each other along a mating direction. In the present embodiment, the mating direction is a direction along an X-direction. In detail, the mating direction of the first connector 100A is a positive-X direction while the mating direction of the second connector 200A is a negative-X direction.

As understood from FIGS. 7 to 12, the first connector 100A is a plug connector which can be accommodated in the second connector 200A in part. The first connector 100A has a plurality of socket contacts 110A, a first housing 120A and a first locking portion 150A. The first housing 120A holds the socket contacts 110A and rotatably supports the first locking portion 150A. The socket contacts 110A are made of metal. Each of the first housing 120A and the first locking portion 150A is made of insulating resin. The first locking portion 150A is formed to be distinct and separated from the first housing 120A.

Figure 7:
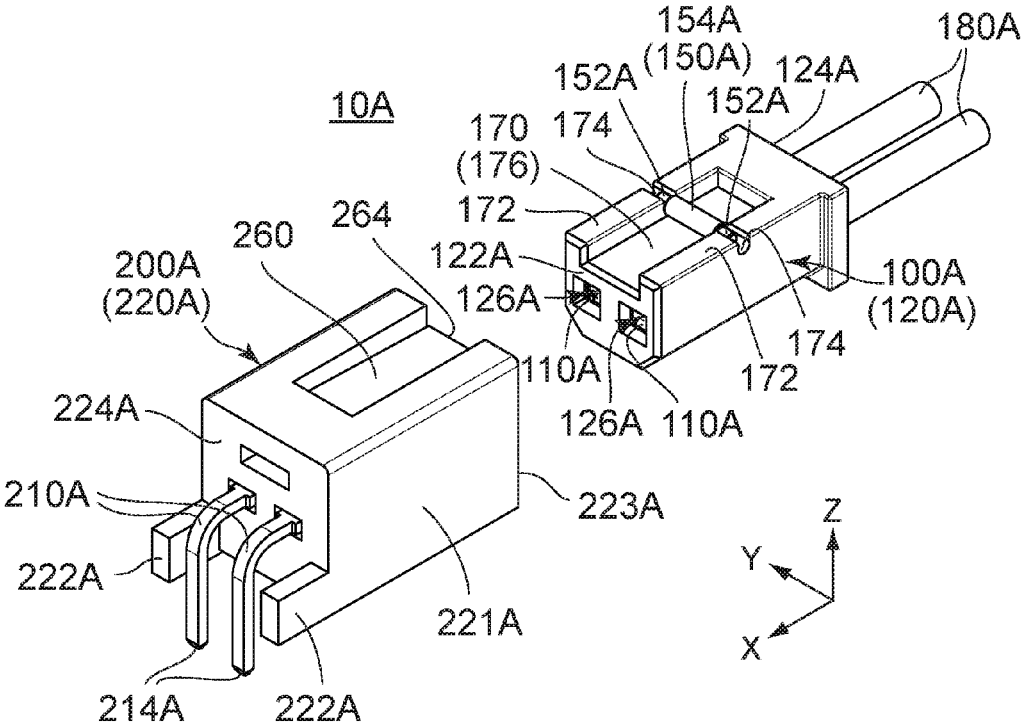
FIG. 7 is a perspective view showing a connector assembly according to a second embodiment of the present invention. A first connector and a second connector are in a separated state.
Figure 8:
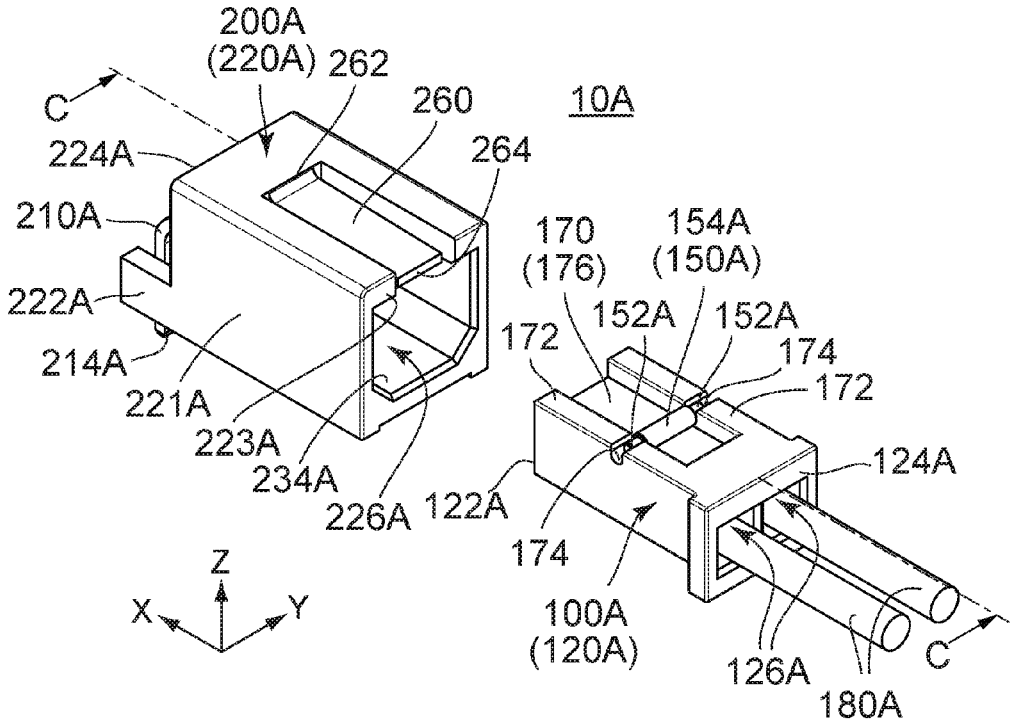
FIG. 8 is another perspective view showing the connector assembly of FIG. 7.

As understood from FIGS. 7 and 8, the first housing 120A is provided with a plurality of holes 126A which pierce the first housing 120A from a front end 122A thereof to a rear end 124A thereof in the mating direction. The holes 126A are arranged in a pitch direction orthogonal to the mating direction. In the present embodiment, the pitch direction is a Y-direction. The socket contacts 110A are accommodated in the holes 126A, respectively. Moreover, the socket contacts 110A are connected to cables 180A inside the first housing 120A, respectively. The cables 180A are routed outward from the rear end 124A of the first housing 120A. However, the present invention is not limited thereto. The present invention is applicable to others irrespective of the number and arrangement of the holes 126A or the socket contacts 110A.

Figure 9:
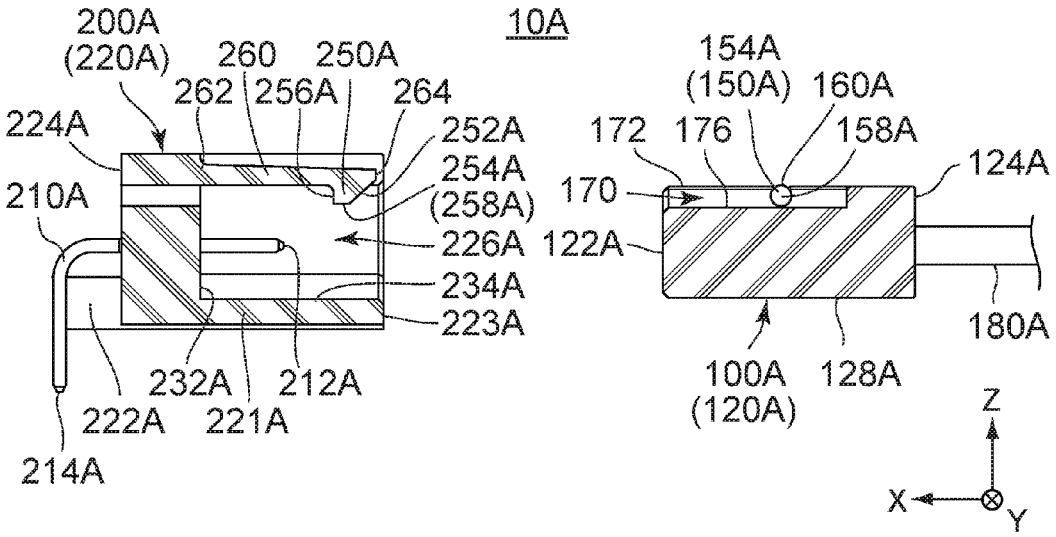
FIG. 9 is a cross-sectional view showing the connector assembly of FIG. 8, taken along C-C line.

As shown in FIGS. 7 to 9, the first housing 120A is formed with a groove portion 170. The groove portion 170 extends toward the rear end 124A of the first housing 120A from the front end 122A of the first housing 120A. The groove portion 170 extends toward the rear end 124A beyond the first locking portion 150A in the mating direction. The groove portion 170 opens upward and toward the front end 122A of the first housing 120A and is hollowed downward. In the present embodiment, an upward direction is a positive-Z direction while a downward direction is a negative-Z direction. The groove portion 170 is defined by a pair of sidewall portions 172 in part. Each of the sidewall portions 172 is formed with a bearing portion 174. The bearing portion 174 is a groove which is made along the pitch direction and has a cross-sectional shape of an imperfect circle. The bearing portion 174 is positioned approximately in the middle of the first housing 120A in the mating direction. The first locking portion 150A is rotatably supported by the bearing portions 174.

As understood from FIGS. 7 to 12, the second connector 200A is a receptacle connector which can accommodate the first connector 100A in part. The second connector 200A has a plurality of pin contacts 210A, a second housing 220A and a second locking portion 250A. The second housing 220A holds the pin contacts 210A. The second housing 220A has a body 221A and a pair of protruding portions 222A protruding rearward from the body 221A. The pin contacts 210A are made of metal. Each of the second housing 220A and the second locking portion 250A is made of insulating resin. The second locking portion 250A is integrally formed with the second housing 220A.

As understood from FIGS. 8 and 9, the body 221A of the second housing 220A has a front end 223A in the mating direction. The body 221A is formed with an accommodation portion 226A which opens in the front end 223A. The accommodation portion 226A accommodates the first connector 100A in part when the first connector 100A and the second connector 200A are mated with each other.

As understood from FIGS. 7 to 9, the pin contacts 210A are held by the second housing 220A so that tips 212A of them are positioned in the accommodation portion 226A while rear ends 214A of them are positioned outside the second housing 220A. The pin contacts 210A are arranged to correspond to the socket contacts 110A. The pin contacts 210A are electrically connected to the socket contacts 110A when the first connector 100A and the second connector 200A are mated with each other. The rear ends 214A of the pin contacts 210A are connected and fixed to a circuit board (not shown).

As understood from FIGS. 7 to 12, the body 221A of the second housing 220A is formed with a resiliently supporting portion 260 supporting the second locking portion 250A. The resiliently supporting portion 260 has a plate-like shape and is formed like a cantilever. The resiliently supporting portion 260 has two ends in a longitudinal direction. One of the ends of the resiliently supporting portion 260 is a fixed end 262 while the other end is a free end 264. The fixed end 262 of the resiliently supporting portion 260 is positioned nearer to the rear end 224A of the body 221A of the second housing 220A. In other words, the fixed end 262 is positioned between the free end 264 and the rear end 224A of the body 221A of the second housing 220A. The resiliently supporting portion 260 extends from the fixed end 262 toward the front end 223A of the body 221A of the second housing 220A along the mating direction. The free end 264 of the resiliently supporting portion 260 is positioned slightly away from the front end 223A of the body 221A of the second housing 220A toward the rear end 224A in the mating direction. The second locking portion 250A is provided near the free end 264. In the present embodiment, the front end of the second locking portion 250A coincides with the free end 264 in the mating direction. Moreover, the second locking portion 250A protrudes partly in the accommodation portion 226A. The resiliently supporting portion 260 is also positioned partly in the accommodation portion 226A. The resiliently supporting portion 260 is resiliently deformable. The free end 264 of the resiliently supporting portion 260 is movable in a direction intersecting with the mating direction. The second locking portion 250A is movable in the direction intersecting with the mating direction according to the resilient deformation of the resiliently supporting portion 260.

As mentioned above, in the present embodiment, one of the first housing 120A and the second housing 220A is formed with the resiliently supporting portion 260 while one of the first locking portion 150A and the second locking portion 250A is supported by the resiliently supporting portion 260. Specifically, the second housing 220A is formed with the resiliently supporting portion 260 while the second locking portion 250A is supported by the resiliently supporting portion 260. Moreover, the remaining one of the first housing 120A and the second housing 220A is formed with the groove portion 170. Specifically, the first housing 120A is formed with the groove portion 170.

As apparent from FIGS. 7 to 9, the first locking portion 150A is formed as with the first locking portion 150 of the first embodiment. In other words, the first locking portion 150A is a solid of revolution and consists of two supported portions 152A and a contact portion 154A. However, the present invention is not limited thereto. The contact portion 154A may be a single sphere, a plurality of spheres arranged in the pitch direction, a plurality of cylindrical columns arranged in the pitch direction, a plurality of disks arranged in the pitch direction or the like. The supported portions 152A have a relatively small diameter (first diameter) and rotatably put in the bearing portions 174. The contact portion 154A has a relatively large diameter (second diameter) and is positioned between the supported portions 152A in the pitch direction. The contact portion 154A comes into contact with the second locking portion 250A when the first connector 100A and the second connector 200A are mated with or separated (removed) from each other. Each of the supported portions 152A and the contact portion 154A has a central axis. The central axes of the supported portions 152A and the central axis of the contact portion 154A coincide with one another. The first locking portion 150A can be easily rotated by an external force applied to the contact portion 154A because the first diameter of the supported portions 152A is smaller than the second diameter of the contact portion 154A. The first locking portion 150A is positioned approximately in the middle of the first housing 120A in the mating direction. The position of the first locking portion 150A is decided on the basis of the position of the second locking portion 250A. This is to allow the first locking portion 150A to function appropriately as a lock mechanism together with the second locking portion 250A.

As shown in FIGS. 9 to 12, the second locking portion 250A is positioned between the front end 223A of the body 221A of the second housing 220A and the rear end 224A in the mating direction. This is to allow the first locking portion 150A to work as the lock mechanism together with the second locking portion 250A when the first connector 100A and the second connector 200A are mated with each other. Moreover, the second locking portion 250A is positioned nearer to the free end 264 of the resiliently supporting portion 260 than to the fixed end 262 of the resiliently supporting portion 260. This is to facilitate moving of the second locking portion 250A caused by resilient deformation of the resiliently supporting portion 260 when the second locking portion 250A comes into contact or is brought into abutment with the first locking portion 150A and to increase moving amount of the second locking portion 250A.

Figure 12:
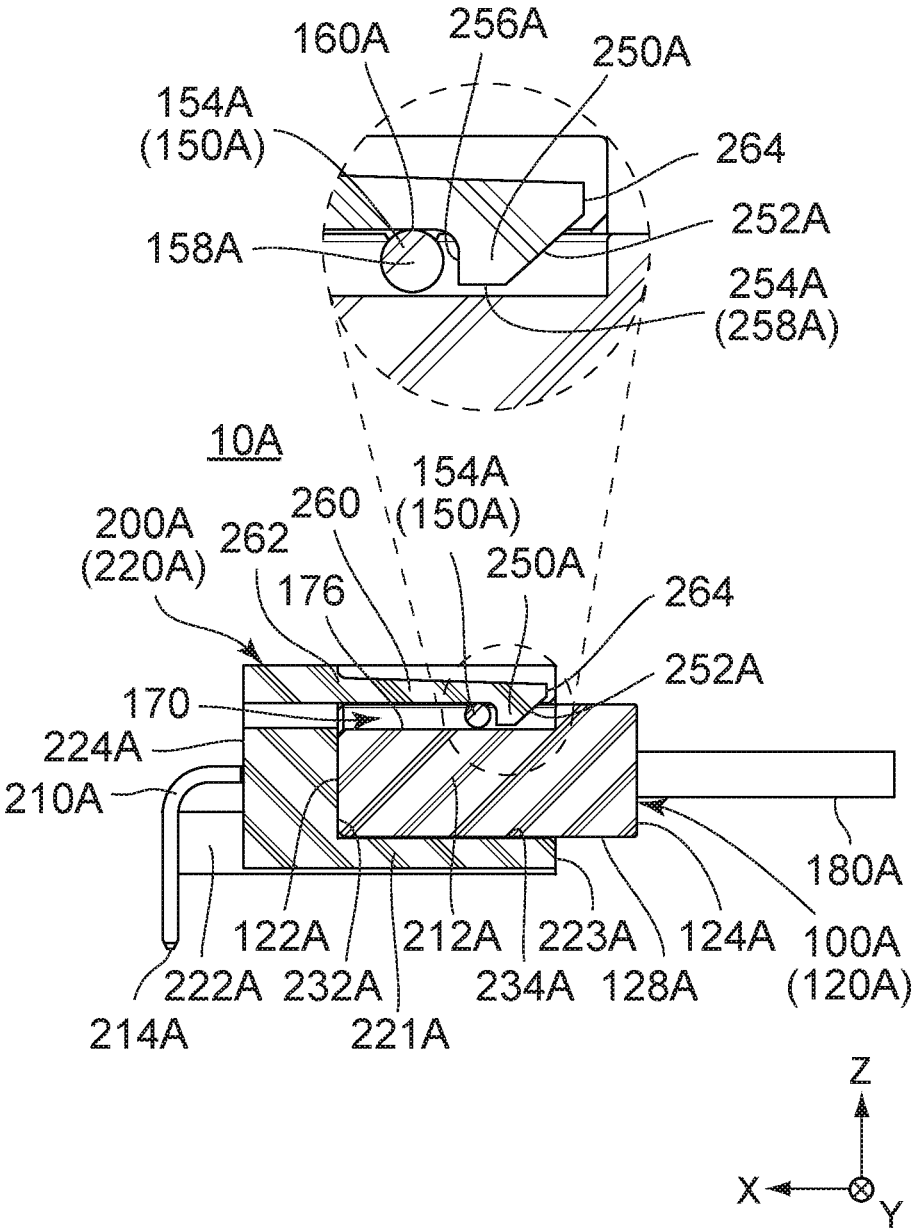
FIG. 12 is a cross-sectional view showing the connector assembly of FIG. 11, taken along D-D line. In the figure, a first locking portion, a second locking portion and the vicinity of them are enlarged and shown.
Figure 13:
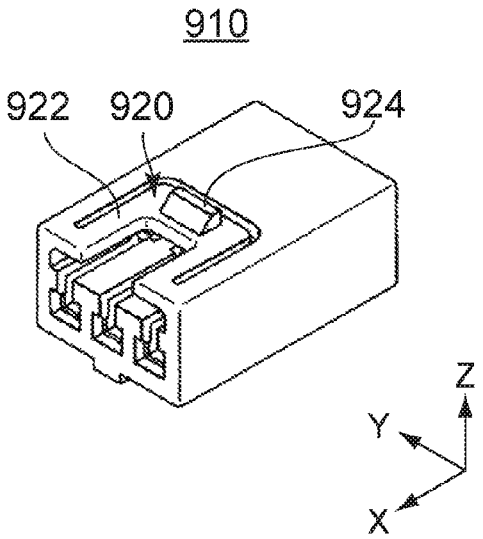
FIG. 13 PRIOR ART
FIG. 13 is a perspective view showing a socket housing of Patent Literature 1.
Figure 14:
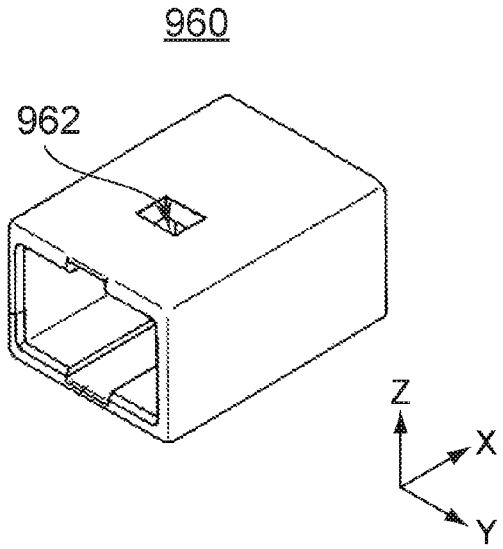
FIG. 14 PRIOR ART
FIG. 14 is a perspective view showing a pin housing of Patent Literature 1.
Figure 15:
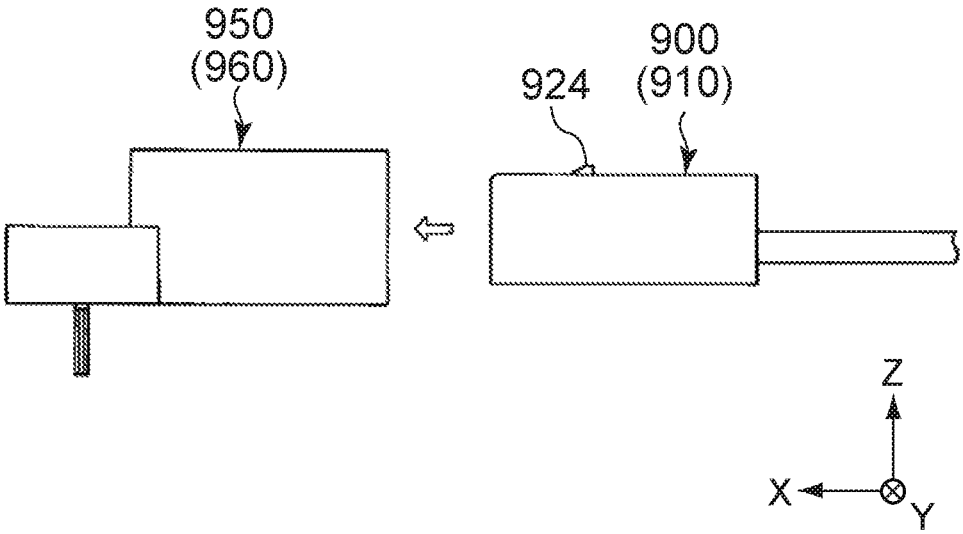
FIG. 15 PRIOR ART
FIG. 15 is a side view showing a connector assembly of Patent Literature 1. A first connector and a second connector are in a separated state.
Figure 16:
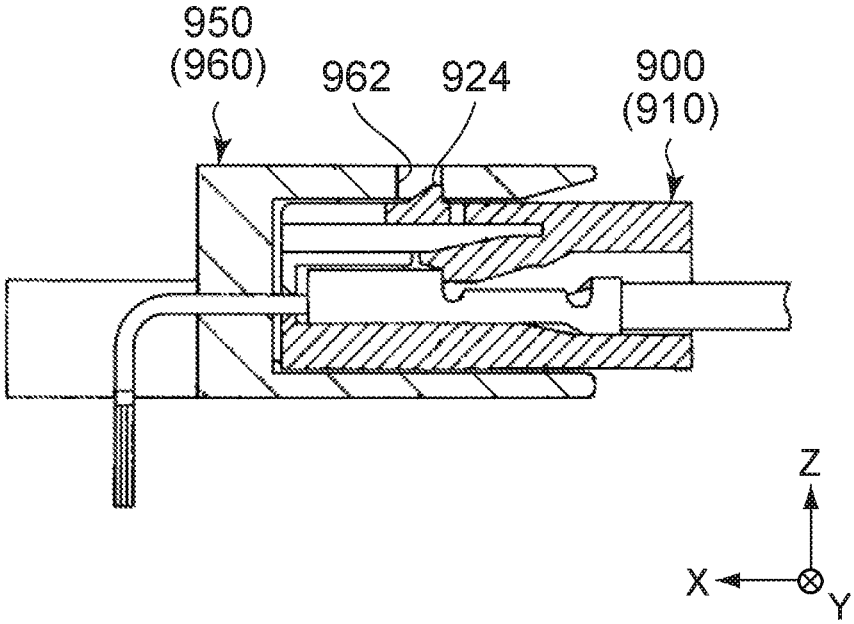
FIG. 16 PRIOR ART
FIG. 16 is a cross-sectional view showing the connector assembly of FIG. 15. The first connector and the second connector are in a mated state.

As shown in FIGS. 9 and 12, the second locking portion 250A has a front surface 252A, an under surface 254A and a rear surface 256A. The front surface 252A is inclined to the mating direction. In detail, the front surface 252A is inclined so that protrusion amount of the second locking portion 250A is gradually increased toward the rear end 224A of the second housing 220A from the front end 223A of the second housing 220A. The under surface 254A is perpendicular to an up-down direction orthogonal to both of the mating direction and the pitch direction. The rear surface 256A is a surface perpendicular to the mating direction. However, the present invention is not limited thereto. Each of the front surface 252A, the under surface 254A and the rear surface 256A may be appropriately designed about a degree of inclination thereof and a size thereof on the basis of a desired lock force. Moreover, at least one of the front surface 252A, the under surface 254A and the rear surface 256A may be a curved surface. On the other hand, the second locking portion 250A and the resiliently supporting portion 260 are smaller than the groove portion 170 of the first housing 120A in size in the pitch direction. Accordingly, when the first connector 100A and the second connector 200A are mated with or separated (removed) from each other, the second locking portion 250A can pass through the groove portion 170 at least in part along the mating direction together with a part of the resiliently supporting portion 260.

Figure 10:
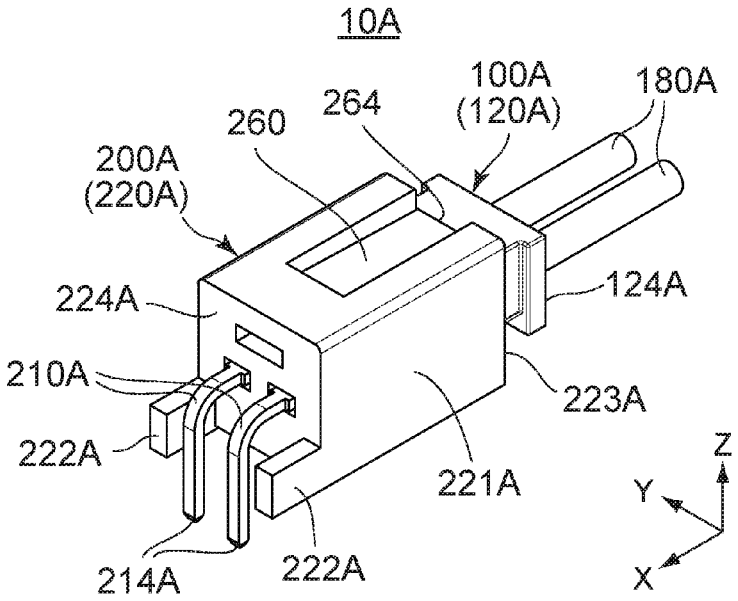
FIG. 10 is a still another perspective view showing the connector assembly of FIG. 7. The first connector and the second connector are in a mated state.
Figure 11:
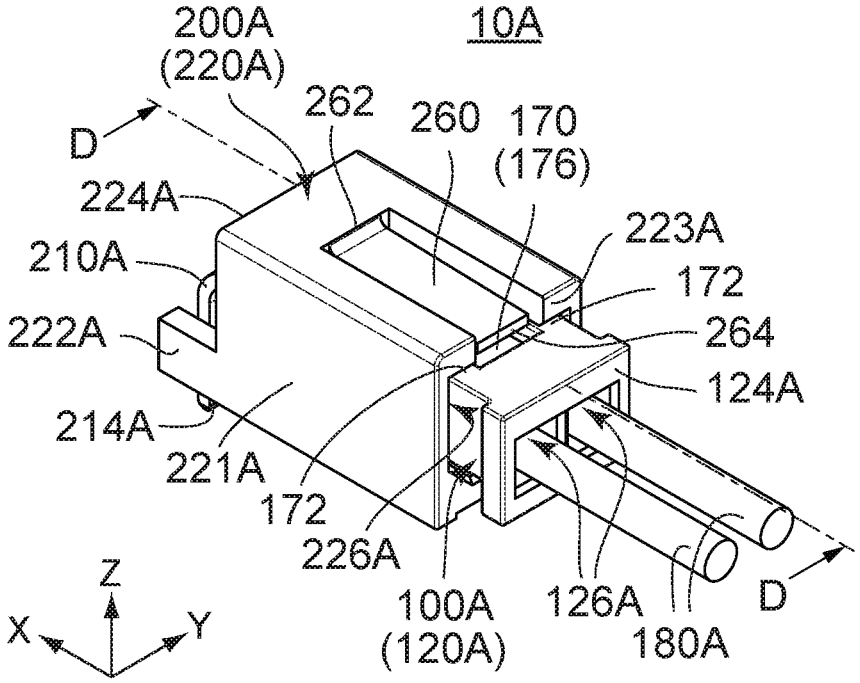
FIG. 11 is another perspective view showing the connector assembly of FIG. 10.

To mate the first connector 100A with the second connector 200A, the first connector 100A and the second connector 200A face each other as shown in FIGS. 1 to 3. In detail, the front end 122A of the first housing 120A faces the front end 223A of the body 221A of the second housing 220A. Then, each of the first connector 100A and the second connector 200A is moved in the mating direction thereof from a separated state as shown in FIGS. 7 to 9. As a result, as shown in FIGS. 10 to 12, the first connector 100A and the second connector 200A shift into a mated state that the first connector 100A and the second connector 200A are mated with each other. As understood from FIGS. 7 to 12, during mating, the first connector 100A is accommodated in the accommodation portion 226A of the second connector 200A in part, and the second locking portion 250A is moved in the groove portion 170 at least in part along the mating direction. As understood from FIGS. 9 to 12, in a state that an under surface 128A of the first housing 120A comes into contact with a bottom surface 234A of the accommodation portion 226A, the second locking portion 250A is apart from a bottom surface 176 of the groove portion 170. This is to prevent abrasion due to contact between them.

As understood from FIGS. 9 and 12, in the middle of the mating, the second locking portion 250A is brought into abutment or comes into contact with the first locking portion 150A. By applying a mating direction force stronger than a first predetermined force to the first connector 100A and the second connector 200A, the front surface 252A of the second locking portion 250A rides on the first locking portion 150A, and then the under surface 254A of the second locking portion 250A rides on the first locking portion 150A. At this time, the resiliently supporting portion 260 is resiliently deformed, and the first locking portion 150A is rotated. Since the front surface 252A is inclined and the first locking portion 150A is the solid of revolution and supported to be rotatable, the second locking portion 250A can relatively easily ride over the first locking portion 150A. Accordingly, abrasion of the first locking portion 150A and the second locking portion 250A is suppressed. When the second locking portion 250A rides over the first locking portion 150A, the second locking portion 250A is stopped by a reaction force of the resiliently supporting portion 260 in a position where it overlaps with the first locking portion 150A when seen along the mating direction. Thus, the first locking portion 150A and the second locking portion 250A lock the mated state of the first connector 100A and the second connector 200A.

When the first connector 100A and the second connector 200A are mated with each other as shown in FIG. 12, i.e. in a locked state, positional relationships among portions are as follows. The second locking portion 250A is positioned between the first locking portion 150A and the rear end 124A of the first housing 120A in the mating direction. On the other hand, the first locking portion 150A is positioned between the second locking portion 250A and a back wall 232A in the mating direction. Moreover, when seen along the mating direction, the first locking portion 150A and the second locking portion 250A have a first extent and a second extent, respectively, in the up-down direction. The first extent of the first locking portion 150A and the second extent of the second locking portion 250A overlap with each other. Furthermore, the first locking portion 150A and the second locking portion 250A have a first end 160A and a second end 258A, respectively, in the up-down direction. A rotation center of the first locking portion 150A is positioned between the second end 258A of the second locking portion 250A and the fixed end 262 in the up-down direction. Still furthermore, the first end 160A of the first locking portion 150A comes into contact with the resiliently supporting portion 260 in the up-down direction. In other words, one of the first end 160A and the second end 258A that corresponds to a remaining one of the first locking portion 150A and the second locking portion 250A, which is not supported by the resiliently supporting portion 260, comes into contact with the resiliently supporting portion 260. However, the first end 160A of the first locking portion 150A may be apart from the resiliently supporting portion 260. In such a case, the first end 160A of the first locking portion 150A may be positioned between the resiliently supporting portion 260 and the second end 258A of the second locking portion 250A in the up-down direction. At any rate, the resiliently supporting portion 260 is above the first locking portion 150A in the up-down direction. In addition, the whole of the resiliently supporting portion 260 is positioned above the first locking portion 150A in the up-down direction. It should be noted that the first end 160A of the first locking portion 150A is a part of a surface of the contact portion 154A. Moreover, the second end 258A of the second locking portion 250A is identical to the under surface 254A. Furthermore, the rotation center of the first locking portion 150A is identical to a central axis 158A of the first locking portion 150A. According to the positional relationships of the portions as mentioned above, the lock state can be certainly maintained.

As understood from FIG. 12, when the first connector 100A and the second connector 200A are applied with a separation direction force for separating them from each other along the mating direction, the first locking portion 150A is brought into abutment with the second locking portion 250A. At this time, an upward force is generated in the vicinity of a free end 264 of the resiliently supporting portion 260, and then the resiliently supporting portion 260 can be resiliently deformed greatly depending on magnitude of the upward force. When the separation direction force is equal to or less than a second predetermined force, the second locking portion 250A cannot ride over the first locking portion 150A. In other words, the first locking portion 150A and the second locking portion 250A maintain the locked state of the first connector 100A and the second connector 200A. In contrast, when the separation direction force exceeds the second predetermined force, the resiliently deformation of the resiliently supporting portion 260 becomes large, and the second locking portion 250A rides over the first locking portion 150A to be moved toward the front end 122A of the first housing 120A. In detail, provided that an edge formed by the under surface 254A of the second locking portion 250A and the rear surface 256A moves upward of the central axis 158A of the first locking portion 150A in the up-down direction, the first connector 100A and the second connector 200A can be separated, after the movement of the edge, from each other by the separation direction force even weaker than the second predetermined force. This is because the force applied from the second locking portion 250A to the first locking portion 150A works to rotate the first locking portion 150A. Thus, the lock of the mated state of the first connector 100A and the second connector 200A is released, and the first connector 100A and the second connector 200A can be separated from each other. In the present embodiment, the front surface 252A of the second locking portion 250A is inclined relative to the mating direction, and the rear surface 256A of the second locking portion 250A is perpendicular to the mating direction. Accordingly, the second predetermined force is greater than the first predetermined force.

As described above, in the connector assembly 10A according to the present embodiment, the first locking portion 150A and the second locking portion 250A function as a friction lock mechanism which locks the mated state when the mating direction force exceeding the first predetermined force is applied thereto and which releases the lock when the separation direction force exceeding the second predetermined force is applied thereto. Since the first locking portion 150A is rotated when the second locking portion 250A rides over the first locking portion 150A, the abrasion of the first locking portion 150A and the second locking portion 250A is suppressed. By the way, the rotation of the first locking portion 150A may causes abrasion between the supported portion 152A and the bearing portions 174. However, the abrasion between the supported portion 152A and the bearing portions 174 hardly affect a lock force produced by the first locking portion 150A and the second locking portion 250A. Therefore, the lock force is hardly decreased by repetition of mating and separating of the first connector 100A and the second connector 200A.

Although the specific explanation about the present invention is made above referring to the embodiments, the present invention is not limited thereto and susceptible of various modifications and alternative forms.

For example, though the resiliently supporting portion is formed on one of the first housing and the second housing in each of the aforementioned embodiments, both of the first housing and the second housing may be provided with resiliently supporting portions. In other words, at least one of the first housing and the second housing may be formed with the resiliently supporting portion in the present invention, and at least one of the first locking portion and the second locking portion may be supported by the resiliently supporting portion to be movable in a direction intersecting the mating direction.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a first connector and a second connector which are mateable with each other along a mating direction, wherein:

the first connector comprises a first housing and a first locking portion;

the first housing has a front end and a rear end in the mating direction;

the first locking portion is positioned between the front end and the rear end of the first housing in the mating direction;

the first locking portion comprises a solid of revolution which is distinct and separated from the first housing and rotatably supported by the first housing;

the second connector comprises a second housing and a second locking portion;

at least one of the first housing and the second housing is formed with a resiliently supporting portion which is resiliently deformable;

at least one of the first locking portion and the second locking portion is supported by the resiliently supporting portion to be movable in a direction intersecting with the mating direction;

when the first connector is mated with the second connector, the second locking portion is positioned between the first locking portion and the rear end of the first housing in the mating direction;

when seen along the mating direction, the first locking portion and the second locking portion have a first extent and a second extent, respectively, in an orthogonal direction orthogonal to the mating direction;

when the first connector is mated with the second connector, the second extent overlaps with the first extent; and when the first connector is mated with the second connector, the first housing is accommodated in the second housing in part.

2. The connector assembly as recited in claim 1, wherein each of the first locking portion and the second locking portion is made of resin.

3. The connector assembly as recited in claim 1, wherein:

the first locking portion has two supported portions supported by the first housing and a contact portion positioned between the supported portions;

the contact portion has at least one cylindrical column or spherical body; and the contact portion comes into contact with the second locking portion when the first connector is removed from the second connector.

4. The connector assembly as recited in claim 3, wherein:

the supported portions have a first diameter;

the contact portion has a second diameter; and the first diameter is smaller than the second diameter.

5. A connector assembly comprising a first connector and a second connector which are mateable with each other along a mating direction, wherein:

the first connector comprises a first housing and a first locking portion;

the first housing has a front end and a rear end in the mating direction;

the first locking portion is positioned between the front end and the rear end of the first housing in the mating direction;

the first locking portion comprises a solid of revolution which is distinct and separated from the first housing and rotatably supported by the first housing;

the second connector comprises a second housing and a second locking portion;

at least one of the first housing and the second housing is formed with a resiliently supporting portion which is resiliently deformable;

at least one of the first locking portion and the second locking portion is supported by the resiliently supporting portion to be movable in a direction intersecting with the mating direction;

when the first connector is mated with the second connector, the second locking portion is positioned between the first locking portion and the rear end of the first housing in the mating direction;

when seen along the mating direction, the first locking portion and the second locking portion have a first extent and a second extent, respectively, in an orthogonal direction orthogonal to the mating direction;

when the first connector is mated with the second connector, the second extent overlaps with the first extent;

the resiliently supporting portion has a fixed end and a cantilever shape extending from the fixed end;

the resiliently supporting portion supports one of the first locking portion and the second locking portion;

the first locking portion has a first end in the orthogonal direction;

the second locking portion has a second end in the orthogonal direction; and when the first connector is mated with the second connector, one of the first end and the second end that corresponds to a remaining one of the first locking portion and the second locking portion is positioned between the resiliently supporting portion and a remaining one of the first end and the second end in the orthogonal direction or positioned to come into contact with the resiliently supporting portion.

6. The connector assembly as recited in claim 5, wherein:

the resiliently supporting portion has a free end; and the one of the first locking portion and the second locking portion that is supported by the resiliently supporting portion is positioned nearer to the free end of the resiliently supporting portion than to the fixed end of the resiliently supporting portion.

7. The connector assembly recited in claim 5, wherein:

the resiliently supporting portion is formed on one of the first housing and the second housing and supports the one of the first locking portion and the second locking portion;

a remaining one of the first housing and the second housing has an extremity in the mating direction;

the remaining one of the first housing and the second housing is formed with a groove portion extending from the extremity to the remaining one of the first locking portion and the second locking portion along the mating direction; and when the first connector is mated with the second connector, the one of the first locking portion and the second locking portion moves in the groove portion to be brought into contact with the remaining one of the first locking portion and the second locking portion and to ride over the one of the first locking portion and the second locking portion.

8. The connector assembly as recited in claim 5, wherein:

the resiliently supporting portion is formed on the first housing; and the one of the first locking portion and the second locking portion is the first locking portion and rotatably supported by the resiliently supporting portion.

9. The connector assembly as recited in claim 8, wherein:

the first locking portion has a rotation center; and when the first connector is mated with the second connector, the second end is positioned between the rotation center and the fixed end in the orthogonal direction.

10. The connector assembly as recited in claim 8, wherein:

the resiliently supporting portion has a free end; and when the first connector is mated with the second connector, the free end is accommodated in the second housing.

11. The connector assembly as recited in claim 5, wherein:

the resiliently supporting portion is formed on the second housing; and the one of the first locking portion and the second locking portion is the second locking portion and supported by the resiliently supporting portion.

12. The connector assembly as recited in claim 11, wherein:

the first locking portion has a rotation center; and when the first connector is mated with the second connector, the rotation center is positioned between the second end and the fixed end in the orthogonal direction.

* * * * *